United States Patent [19]

Nakauchi

[11] 4,027,762

[45] June 7, 1977

[54] DOT PRINTER

[75] Inventor: Shunsaku Nakauchi, Mitaka, Japan

[73] Assignee: Kokusai Gijutsu Kaihatsu Kabushiki Kaisha, Tokyo, Japan

[22] Filed: Nov. 11, 1974

[21] Appl. No.: 522,962

[30] Foreign Application Priority Data

| | | |
|---|---|---|
| Nov. 10, 1973 | Japan | 48-125932 |
| Nov. 21, 1973 | Japan | 48-130076 |
| Dec. 26, 1973 | Japan | 48-143983 |

[52] U.S. Cl. ..... 197/1 R; 197/15; 101/1; 346/75; 235/61.11 J; 235/201 ME

[51] Int. Cl.² ..... B41J 23/20

[58] Field of Search ..... 197/1 R, 15; 101/1; 346/75; 235/61.11 J, 201 ME

[56] References Cited

UNITED STATES PATENTS

| | | | |
|---|---|---|---|
| 531,352 | 12/1894 | Wier | 197/15 |
| 534,073 | 2/1895 | Morris | 197/15 |
| 2,869,455 | 1/1959 | Knutsen | 101/93.05 |
| 2,904,070 | 9/1959 | Lynott | 235/201 ME X |
| 3,152,858 | 10/1964 | Wadey | 346/75 |
| 3,159,099 | 12/1964 | Wadey | 101/1 |
| 3,217,640 | 11/1965 | Bradshaw | 197/1 R X |
| 3,226,530 | 12/1965 | Greenblott et al. | 235/61.11 J |
| 3,315,775 | 4/1967 | Schonfeld | 197/15 |
| 3,572,486 | 3/1971 | Hebel et al. | 197/15 |
| 3,729,079 | 4/1973 | Zenner et al. | 101/93 C X |
| 3,911,818 | 10/1975 | MacIlvaine | 197/1 R X |

*Primary Examiner*—Ralph T. Rader
*Attorney, Agent, or Firm*—Sughrue, Rothwell, Mion, Zinn & Macpeak

[57] ABSTRACT

Each wire of a wire printer is driven by a separate pneumatic motor. Each motor is actuated by compressed air which is selectively passed through an electrically operated valve for each motor. Each valve is actuated by an electric signal indicating whether the associated printing wire should be driven to print a desired character. Coupled between a compressed air source and all of the individual valves is an electrically operated pressure control valve which is normally closed to block transmission of compressed air from the source to the individual valves. After the individual valves are opened by electric signals to permit the printing of a desired character, the control valve is then opened to permit transmission of the compressed air through the opened individual valves to actuate the individual pneumatic motors to drive the print wires necessary to print the desired character.

12 Claims, 12 Drawing Figures

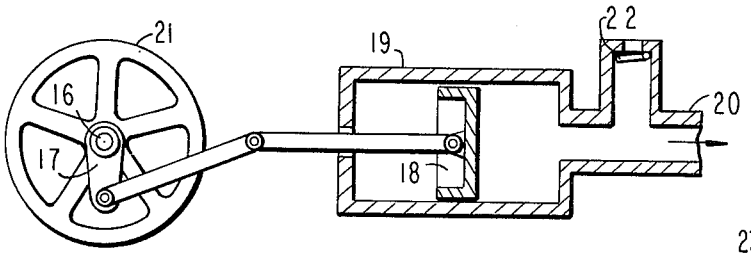
FIG. 5
FIG. 7
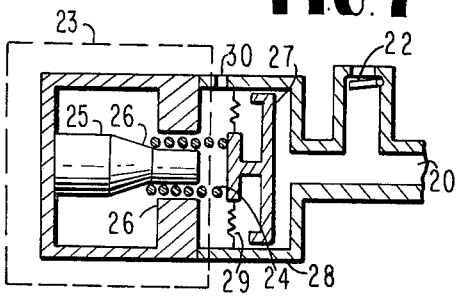
FIG. 6
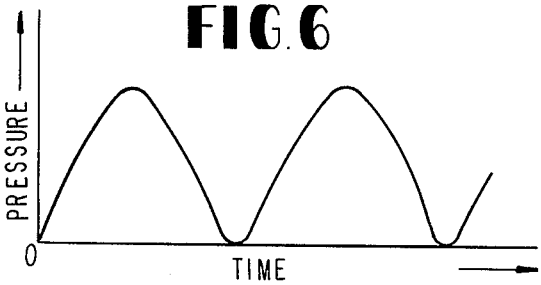
FIG. 8
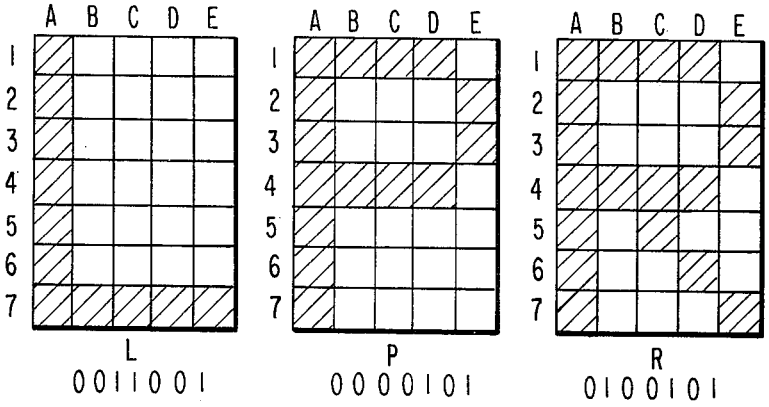
FIG. 9
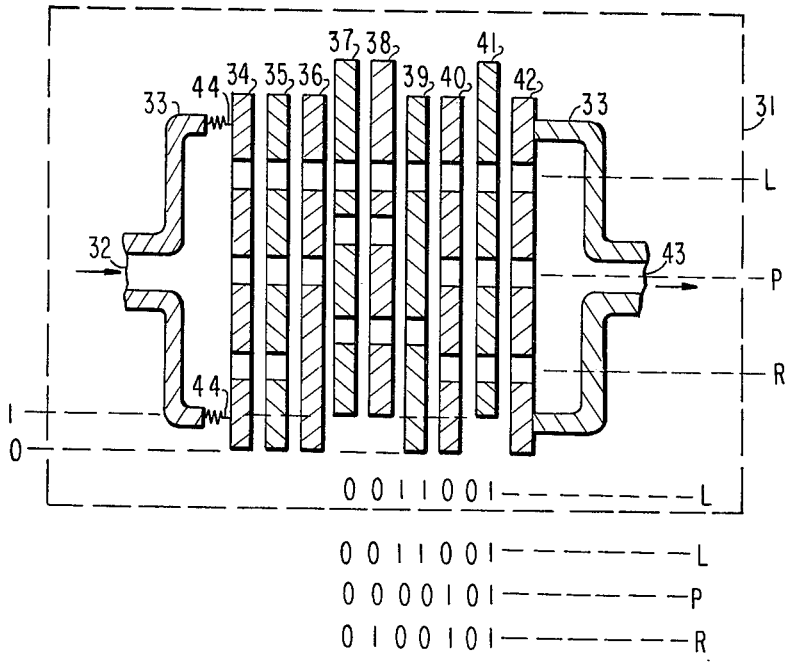

DOT PRINTER

BACKGROUND OF THE INVENTION

1. Field of the Invention

The present invention relates to an impact type dot printer using wires.

2. Description of the Prior Art

Many impact type dot printers have been manufactured for many years, but all these printers print by operating wires which on impact print dots using the electrical force obtained from an electric magnet and the like. Therefore, these printers have the defect that the motor to operate the wires is large in size and in weight. As a result, it has been almost impossible to manufacture a dot type line printer equipped with more than 1,000 motors because of the large size, weight and cost involved.

SUMMARY OF THE INVENTION

An object of this invention is to provide a dot printer using a motor to drive wires which are very small-sized and with which quick motion is possible.

Another object of this invention is to provide a means to reduce the load of the electric input controlling a pneumatic motor and facilitate the miniaturization of a dot printer.

A further object of this invention is to provide a dot printer in which the pressure of pneumatic pressure source is periodically changed in order to facilitate the working of electric controlled valves and reduce power consumption.

A still further object of this invention is to provide a means whereby electrically controlled valves can operate as a character generator and thereby reduce the cost.

This invention accordingly provides a dot printer comprising a pneumatic pressure source containing air at a pressure higher than atmospheric pressure, a conduit which passes compressed air of the pneumatic pressure source, a plurality of the pneumatic motors driven by compressed air, means responsive to an electric singnal to control the volume of air compressed into the pneumatic motor; wires to dot-print which are operated by movable portions of the pneumatic motors, means to decide the positions at which the wires dot-print, and means to carry paper for printing to the positions at which the wires dot-print.

BRIEF DESCRIPTION OF THE DRAWINGS

FIG. 5 is a schematic illustration of the construction of the pneumatic pressure source which is capable of periodically generating compressed air in this invention.

FIG. 6 is an illustration showing the output characteristics of the pneumatic pressure source in FIG. 5.

FIG. 7 is a sectional view of an other pneumatic pressure source in this invention.

FIG. 8 is an illustration explaining a process to produce a character using dots.

FIG. 9 is a partial sectional view showing the basic construction of an electrically controlled valve.

DESCRIPTION OF PREFERRED EMBODIMENTS

With reference now to the drawings, the details of this invention are explained as follows.

Figure 1:
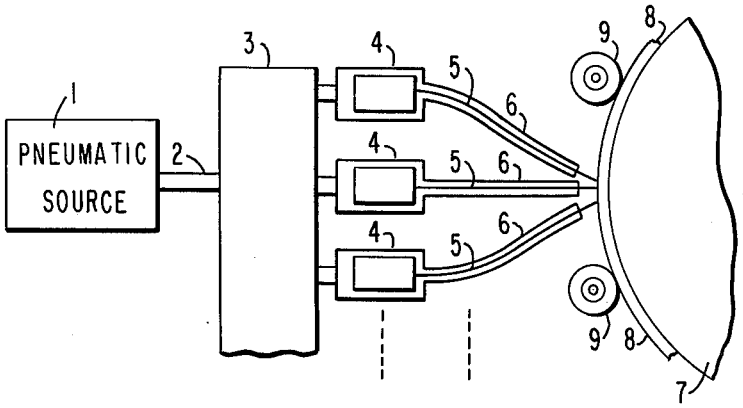
FIG. 1 is a schematic illustration of the basic construction of the printer of this invention.

FIG. 1 is a schematic illustration of the basic construction of the printer in this invention. In FIG. 1, 1 is a pneumatic pressure source having a pressure higher than atmospheric pressure, 2 is a conduit for passing compressed air, 3 is means to control the compressed air by electrical force, for example, electrically controlled valves, means the reference numerals 4 designate pneumatic motors driven by compressed air, 5 are wires which are connected with pneumatic motors 4 and move right and left in FIG. 1 with the movement of the pneumatic motors 4, 6 are conduits controlling the moving direction of wires, 5, 7 is a platen on which a paper for printing is rolled, 8 is paper for printing, and 9 is device to feed paper 8, for example, a roller.

With reference to FIG. 1, the motion and characteristics of the printer in this invention are explained. In general, the input of a dot-printer is provided by electric signals. First, the action the devices in FIG. 1 produce when electric signals are provided is explained.

Pneumatic pressure source 1 in FIG. 1 always holds air having a pressure higher than atmospheric pressure, and this compressed air goes through conduit 2 and is provided to electrically controlled valve 3.

For pneumatic source 1, a tank and the like can be used for storing compressed air generated by a compressor which is driven by, for example, a electric motor.

Electrically controlled valve means 3 opens or closes a valve according to an external electric signal input, thereby sending air to Pneumatic Motor 4 or not.

One of the pneumatic motors 4, receiving compressed air from electrically controlled valve means 3, pushes out a corresponding wire 5 toward the right in FIG. 1. Wire 5 moves toward the right within pipe 6, and the tip emerges from pipe 6, strikes paper 8 on platen 7 and prints a dot at the point of impact.

A suitable number of pneumatic motors 4 are provided according to the object of printing. For example, in case of a line printer, pneumatic motors are lined up covering the entire width of the paper for printing.

When compressed air is not supplied to a pneumatic motor 4 it is stationary, and wire 5 is drawn toward the left in FIG. 1 by means of a spring or the like. In this case, the stationary position of pneumatic motor 4 including the retraction of wires 5 is adjusted so that the wires 5 do not contact the surface of paper 8.

As described above, paper 8, which has been printed by the action of compressed air, moves by the action of roller 9, and a new portion of paper 8 comes into a position opposite the tips of wires 5 in preparation for the next printing action.

As Pneumatic Motor 4, a mechanism having a moving part which moves when compressed air is applied, is used; for example, this moving port may be a bellows, a diaphragm, or a piston, each of which is well known.

Figure 2:
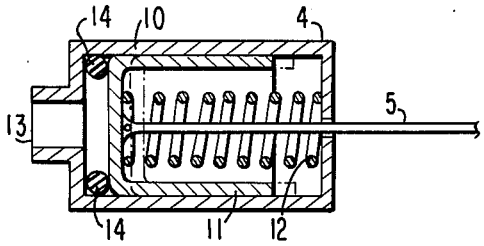
FIG. 2 is a schematic illustration of the construction of an example of pneumatic motor in this invention.

In FIG. 2, an example of a pneumatic motor 4 utilizing a piston mechanism, one of the above described three means, is illustrated.

FIG. 2 is a sectional view showing the outline of the mechanism of pneumatic motor 4, in which 10 is a cylindrical case, 11 is a piston, 12 is a spring, 13 is an air inlet, and 14 is a damper.

In FIG. 2, when compressed air is sent though inlet 13 into the inside of pneumatic motor 4, piston 11, installed along the inside wall of cylindrical case 10 so as to move back and forth in FIG. 2, is moved by the pressure of the air to the position indicated by the dotted line. Following the movement, wire 5 fitted on piston 11 is moved right. When the compressed air is removed, piston 11 is retracted in the left direction to the position of the solid line by the action of spring 12. Damper 14 is provided in order to prevent a noise from being made as a result of the collision of cylindrical case 10 and piston 11 on retraction.

As described above, since the energy of the compressed air of pneumatic source 1 drives wire 5 and since electrically controlled valve 3 controls the compressed air, then the design can be such that piston 11 receives the pressure of the compressed air over an area wider than the area of inlet 13 only by the control of air by electrically controlled valve 3 over the narrower inlet 13 of pneumatic motor 4. Therefore, it is possible to achieve a large energy to drive wire 5 from a small controlling energy.

Figure 3:
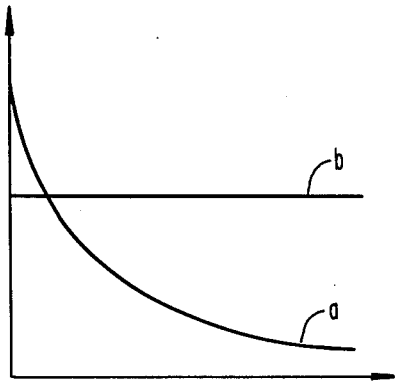
FIG. 3 is an illustration showing the characteristics of the electric motor and the pneumatic motor in this invention.

In general, as shown by the curve *a* in FIG. 3, the relation between the stroke and absorbing power of electromagnetic force is not definite. However, in the case of pneumatic motor 4, as long as the air pressure is determined, the relation between the stroke and force is definite, as shown by the straight line 6 in FIG. 3. This means that, even if wire 5 becomes worn by repeated printing work and the stroke of wire 5 has changed, no great change in the striking force of wire 5 results, as long as wire 5 is driven by pneumatic motor 4. This is an advantageous point as compared with directly driving wire 5 using electromagnetic force.

Even if the size of pneumatic motor 4 is not changed, the output can be changed by changing the air pressure. This means that pneumatic motor 4 can be miniaturized by increasing the air pressure. Also in an actual example, a driving force sufficient to print is achieved by supplying a pressure of 1 to 2 atmospheres to a pneumatic motor of a diameter of approximately 5 mm.

The possibility of miniaturization is necessary especially for usage such as a motor for driving 100 to 1000 wires as is required as in the case of a dot type line printer.

Meanwhile, since it is possible to change the output of pneumatic motor 4 by changing the air pressure, one of the characteristics of this invention is that the contrast of the printing can be adjusted simply by simultaneously adjusting the pressure of the air supplied to the pneumatic motor 4 by a method such as increasing or decreasing the pressure of pneumatic pressure source 1.

Unlike an electromagnet, pneumatic motor 4 generates almost no heat during operation. Therefore, an advantageous point is also that driving motors in high density can be assembled.

Figure 4:
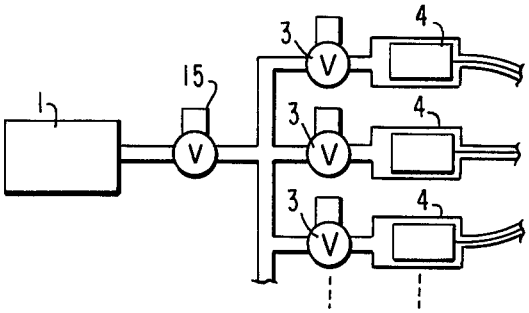
FIG. 4 is a schematic illustration of the construction of an improved printer in this invention.

FIG. 4 is a schematic illustration of the construction of a dot printer obtained with an improvement of the dot printer in FIG. 1.

15 in FIG. 4 is an electrically controlled valve. The improvement of the dot printer in FIG. 4 from the dot printer in FIG. 1 lies in the installation of electrically controlled valve 15. In the system of FIG. 1 since electrically controlled valve 3 has to open or close valves under the pressure of compressed air, the load of the valve naturally increases. Accordingly, a large-sized electric magnet becomes necessary for driving the valves and the consumption of power increases. However, in the case of FIG. 4, the pressure of the compressed air is always under the control of electrically controlled valve 15 and no compressed air is allowed to be present on the load side of electrically controlled valve 15, that is, on the side of each electrically controlled valve 3 when printing is not being performed. Under this condition, the selected electrically controlled valves 3 are first operated, and then, electric controlled valve 15 is operated in order to simultaneously supply air to all corresponding pneumatic motors 4.

Namely, of the plural pneumatic motors 4, only the selected electrically controlled valves 3 are operated, and then electrically controlled valve 15 is opened to operate the corresponding selected pneumatic motors 4. By this means, the only load for each electrically controlled valve 3 is the weight of the valve; therefore an advantageous point also is that the size of each electrically controlled valve 3 can be reduced and its electric power consumption is reduced.

Since each pneumatic motor 4 requires an electrically controlled valve, the size of this electrically controlled valve is very important in cases such as where about 1,000 pneumatic motors are needed as in the case of a line printer.

Since only one electrically controlled valve 15 is needed regardless of the number of electrically controlled valves 3, the size or electric power consumption of this electrically controlled valve 15 is not an important problem.

As mentioned above, by installing electrically controlled valves 15, electrically controlled valve 3 can be miniaturized and the overall economy as a dot printer can be improved compared with FIG. 1.

With dot printers in general, with plural dots, often only a specific dot is used for serial dot printing, although such need varies with the letters to be printed and the like. In this case, with a dot printer including electrically controlled valve 15, electrically controlled valve 3 to control the dot for serial printing can be left alone with electrically controlled valve 3 open. Therefore, an advantageous point is also that the operating time of electrically controlled valve 3 can be reduced in a large measure as compared with those of an electric magnet of a conventional dot printer which directly operates wires 5 by electromagnetic force and the life of electrically controlled valve 3 becomes that much longer.

Next, another means to improve the dot printer in FIG. 1 is explained.

This improvement employs a pneumatic pressure source which generates compressed air each time pneumatic motor 4 needs compressed air and does not generate compressed air at other times.

FIG. 5 is schematic illustration of a piston type pneumatic pressure source, which is shown as an example of a pneumatic pressure source 1 in this invention.

In FIG. 5, 16 is a rotating shaft driven by a motor and the like, 17 is a crank which is mounted on and rotates along with rotating shaft 16, 18 is a piston driven right and left by crank 17 in FIG. 5, 19 is a cylindrical case, 20 is an outlet for compressed air, 21 is a flywheel mounted on rotating shaft 16, and 22 is a check valve for suction of air.

The action of pneumatic pressure source in FIG. 5 is now explained. When rotating shaft 16 is driven by an electric motor or the like, crank 17 also rotates, and piston 18 also moves right and left, thereby air in the cylindrical case is compressed, and compressed air is driven out of outlet 20.

Air driven out of outlet 20 is sent through conduit 2 and electrically controlled valve 3 in FIG. 1 and supplied to pneumatic motor 4.

If rotating shaft 16 rotates at a definite rate, then the pressure of compressed air supplied from outlet 20 varies sinusoidally as shown in FIG. 6.

When this compressed air is supplied to air motor 4 shown in FIG. 2, piston 11 begins to move toward the right in FIG. 2 from the time the pressure of compressed air has increased so that the force of the compressed air against piston 11 becomes stronger than the force of spring 12. Also, if the pressure of the compressed air is reduced beyond a certain level so that the force of spring 12 in pushing piston 11 becomes stronger than the force of the compressed air against piston 11, then piston 11 moves toward the left in FIG. 2.

Therefore, if the size, stroke, and speed of piston 18 in FIG. 5 are now suitably selected, then piston 11 of pneumatic motor 4 in FIG. 2 reciprocates between the positions shown by the dotted line and the solid line in FIG. 2. At this time, the periodic time of the reciprocating motion of piston 11 corresponds to that of piston 18.

As described above, with the pneumatic pressure source in FIG. 5, the pressure varies periodically. Therefore, if adjustment is made so that electrically controlled valve 3 will operate at the time of low pressure synchronously with the above period, then electrically controlled valve 3 operates under a low air pressure, not under the high air pressure used to drive piston 11. As a result, the load on the valves is light, and electrically controlled valves can be manufactured that much smaller and at a lower cost.

Also, as already explained for the system in FIG. 4, an electrically controlled valve 3 controlling a wire, in a serial printer, can be left alone in an open condition; therefore the motion times of the electric magnet which are needed to drive electrically controlled valve 3 are reduced to a large extent from that in FIG. 1. Accordingly, the life time of electrically controlled valve 3 can be prolonged and the electric power consumption can be reduced. In addition, the period that compressed air is generated is not continuous, so that any loss caused by air leakage can be reduced.

The necessary pressure can be produced by one stroke of piston 18, the time taken for achieving the required pressure can be reduced.

As described above, many advantageous points can be obtained from a pneumatic pressure source of a simple construction as shown in FIG. 5.

Next, an explanation is made with regard to the function of flywheel 21 in FIG. 5. With the pneumatic pressure source in FIG. 5, compressed air generated by piston 18 drives pneumatic motor 4, but all the compressed air is not consumed at that time, and the greater part of the compressed air remains at high pressure in conduct 2 or cylindrical case 19. When piston 18 moves toward the left in FIG. 5, the potential energy of the above compressed air pushes piston 18 to the left.

If this action is utilized for driving crank 17 and flywheel 21 is driven at that time, then the potential energy of compressed air, which remains and is not consumed by pneumatic motors 4, can all be converted to kinetic energy of flywheel 21. The kinetic energy of flywheel 21 aids the next compression stroke of piston 18 and therefore, the load of the motor driving rotating shaft 16 can be reduced to only the energy consumed by pneumatic motors 4 and the efficiency is increased greatly due to the installation of flywheel 21.

Check valve 22 for suction of air in FIG. 5 is for compensating for the air consumed by pneumatic motors 4 and the like from the atmosphere. This check valve 22 absorbs air from the atmosphere when the air pressure at outlet 20 is reduced below atmospheric pressure, and is closed when the air pressure at outlet 22 is higher than atmospheric pressure.

FIG. 7 shows another example for pneumatic pressure source 1 in this invention.

In FIG. 7, 23 is moving coil type motor whose movement is straight, 24 is a moving coil of the foregoing motor 23, 25 is a permanent magnet, 26 is a yoke which conducts the magnetic flux of permanent magnet 25 to moving coil 24, 27 is a piston, 28 is a cylindrical case of piston 27, 29 is diaphragm, and 30 is ventilating outlet to the open air.

In FIG. 7, when an electric current flows through to moving coil 24, moving coil 24 generates a thrust in the right or left direction in the drawing according to the quantity or direction of the current.

Therefore, if piston 27 is connected with moving coil 24, then piston 27 moves right and left due to this thrust, thereby generates or extinguishes compressed air, namely, operates the same as piston 18 in FIG. 5. It is the mass of piston 27 and spring 29 which operate the same as flywheel 21 in FIG. 5. In order to allow the pneumatic pressure source in FIG. 7 to operate efficiently, a good way to operate moving coil 24 is using a driving current of the same frequency as the frequency of the mechanical resonance determined mainly by spring 29 and piston 27. In this way, moving coil type motor 23 needs to supply only the energy consumed mainly by pneumatic motor 4, and so it is efficient.

In FIG. 7, when spring 29 is airtight, then it is possible to allow spring 29 to fulfill the function of spring 27 simultaneously.

With the dot printer in this invention, electrically controlled valve 3 is operated at the time when the pressure of the compressed air is low; therefore the pneumatic pressure source must provide a signal so that electrically controlled valve 3 can decide when to operate.

These are various means for the above purpose. For example, in FIG. 5, a good way is to obtain the signal from a position detecting device for crank 17, or in FIG. 7 from a position detecting device for moving coil 24.

As described above, it is possible to improve the performance of a dot printer in a large measure by installing a pneumatic pressure source which intermittently increases the pressure and an electrically controlled valve which works synchronously with the pressure source.

Next, a further means to improve the dot printer in FIG. 1 is explained.

This invention improves electrically controlled valve 3 so that it functions as a character generator.

The means to improve electrically controlled valve 3 is explained in detail in FIG. 8 to FIG. 12.

The improved electrically controlled valve is shown as 31 in the drawings.

The principle of the motion of electrically controlled valve 31 in this invention is entirely the same for complex Chinese characters and alpha-numeric symbols. Therefore, this explanation is made with regard to a dot printer which prints alpha-numeric symbols using 35 dots of 5 rows × 7 columns.

In FIG. 8, shows a case in which the three letters of L, P, R are represented by the use of some of the 35 dots.

In FIG. 8 7-bit character codes are used to represent each letter, and the character codes of L, P, R are set as 0011001, 0000101, 0100101 respectively.

When the above character codes are input, the dot printer must print letters represented by the combinations of dots as shown in FIG. 8.

As shown in FIG. 8, some of the 35 dots are used for more than one letter and are not used for other letters. For example, the B-1dot is used for P and R and is not used for L, and the D-7 dot is used only for L and not used for P or R.

From observing a certain dot of a dot printer, it can be seen that this same dot is used for certain letters. Thus, the principle of action is explained by first observing this one dot only.

The A-1 dot in FIG. 8 is taken as an example and the output method is explained.

In FIG. 9, the parts to determine the action of the A-1 dot when the three letters of L, P, R are printed are removed from the basic composition of electric controlled valve 31 in this invention, and its sectional view is shown.

In FIG. 9, 32 is an inlet for compressed air, 33 is a valve case cylinder, 34 is an air passage board containing openings through which compressed air is passed through definite positions only. Seven boards from 35 to 41 are character code boards which take upper or lower positions in response to character codes "0", "1" and form valves to control the passage of air, and have openings to pass the air, which has passed air passage board 34, through either of position "1" or position "0". 42 is an air passage board to pass only the air which has passed through character code boards 35 to 41, and 43 is an air outlet to send the passed-air to pneumatic motor 4 and these air outlet are provided in the same number as pneumatic motors 4. 44 is an elastic and airtight connecting means which connects case 33 and air passage board 34.

In FIG. 9, 7 character codes boards 36 to 41 are provided corresponding to the 7-bit character codes; and, though it is not illustrated, these character codes can be operated up and down in response to input signals by using a conventional electric converter, such as an electromagnet.

In an illustration, these character code boards take the upper positions when the input signal is "1" and take the lower positions when the input signal is "0". The example shows the positions of character code boards when the input signal is 0011001 (signal representing L).

Now, the A-1 dot must be used for all the character codes of L, P, R.

Namely, the compressed air, which has entered through inlet 32 in response to the three character codes, must pass from outlet 3, and in addition no compressed air is allowed to pass against codes other than the above ones. The action is explained according to FIG. 9.

The method to form the openings on the character code board is explained. Character code boards 35 to 41 have their openings corresponding to the three letters of L, P, R. in the example shown in FIG. 9, three holes for each of the three letters of L, P, R are made on each of character code boards 35 to 41. If character code board 35 is taken as an example, openings for the three letters of L, P, R are made on this character code board so that the air, which has passed through the three openings of air passage board 34, can pass through at the position of signal 0. Next, in the case of character code board 36, openings are made so that compressed air can pass at the position of 0 for letters L, P, and can pass at the position of 1 for letter R.

In a similar manner, also for character code boards 37 to 41, three openings are made, corresponding to signals given to letters L, P, R.

As a result, for the character code 0011001, the uppermost opening in FIG. 9 only passes compressed air; for the character code 0000101, the second opening passes air; and for the character code 0100101, only the third opening passes compressed air. With any combination of codes other than the above, no openings allow compressed air to pass.

Thus, the A-1 dot, which is used only for L, P, R, prints only at the necessary time, operated by pneumatic motor 4 which receives input only at the times where L, P, R, are to be printed.

As can be seen from the above explanation, speaking of a certain dot, as many openings as the number of characters for which the dot is used are made, according to character codes "0" and "1", at the upper or lower positions of character code boards 35 to 41.

For example, if it is assumed that the A-1 dot is used for 18 of the 36 alpha-numeric symbols, then 18 openings are made on each of the character code boards 35 to 41 which correspond to the A-1 dot.

In FIG. 8, the number of times each dot is used are not the same. Therefore, the numbers of openings actually used for each dot on character code boards 35 and 41 are different.

Figure 10:
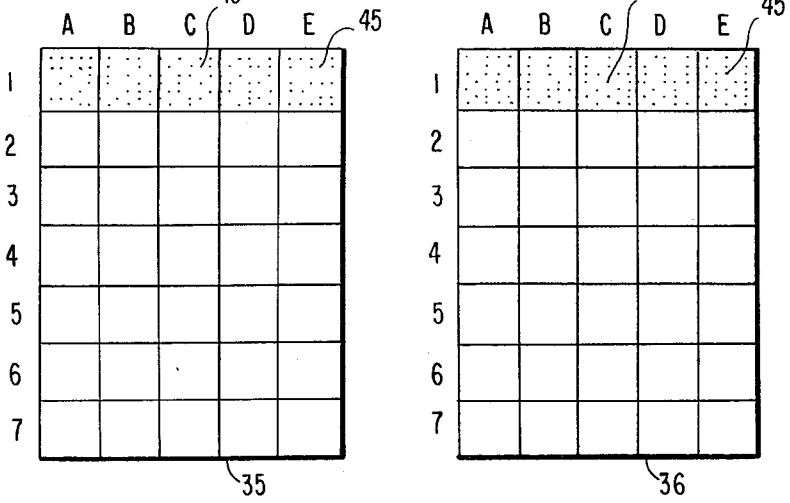
FIG. 10 is a plan of a character code board.

FIG. 10 is a plan showing the overall construction.

In FIG. 9, 7 character code boards 35 to 41 are shown, but the constructions of these boards are almost the same. Therefore, only two character code boards 35, 36 are illustrated as their representative.

Character code boards 35, 36 are used for expressing letters using 35 dots. Therefore, one code board is divided into 35 parts, and in each part, as many openings 45 as the number of times that the dot corresponding to the part are used, are made at the upper or lower positions according to character code 0, 1. That status is shown in FIG. 11, which is an enlarged drawing.

Figure 11:
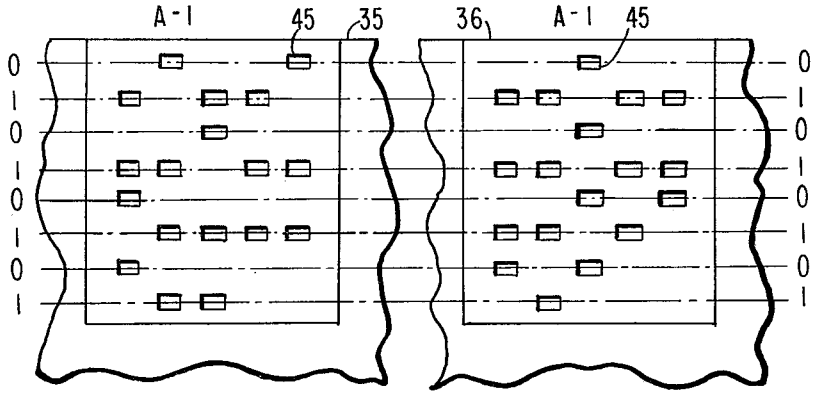
FIG. 11 is an enlarged illustration of a part of FIG. 10.

FIG. 11 is an enlarged drawing of part of A-1 which is part of FIG. 10, and an illustration of the case where the A-1 dot is used 18 times.

The number of times that one dot is used varies with the dots. If the sizes of those 35 parts are made the same, the density of the openings in each part varies according to the number of times that the corresponding dots is used. If the density of the openings in each part is made the same, the sizes of these parts are different.

FIG. 10 is an illustration when the sizes of the 35 parts are the same.

In FIG. 10, of 35 parts, openings are shown only for the first line, but openings are made in the same manner also in the other pants.

The total number of openings on character code boards 35 to 41 is the product of the number of letters to be represented and the average number of dots used for each letter. For example, if 15 dots are used for one letter on the average to represent 36 letters, the total number of holes on character code boards 35 to 41 is $36 \times 15 = 540$. The numbers of openings in the parts which correspond to the same dot through character code boards 35 to 41 are all the same.

Figure 12:
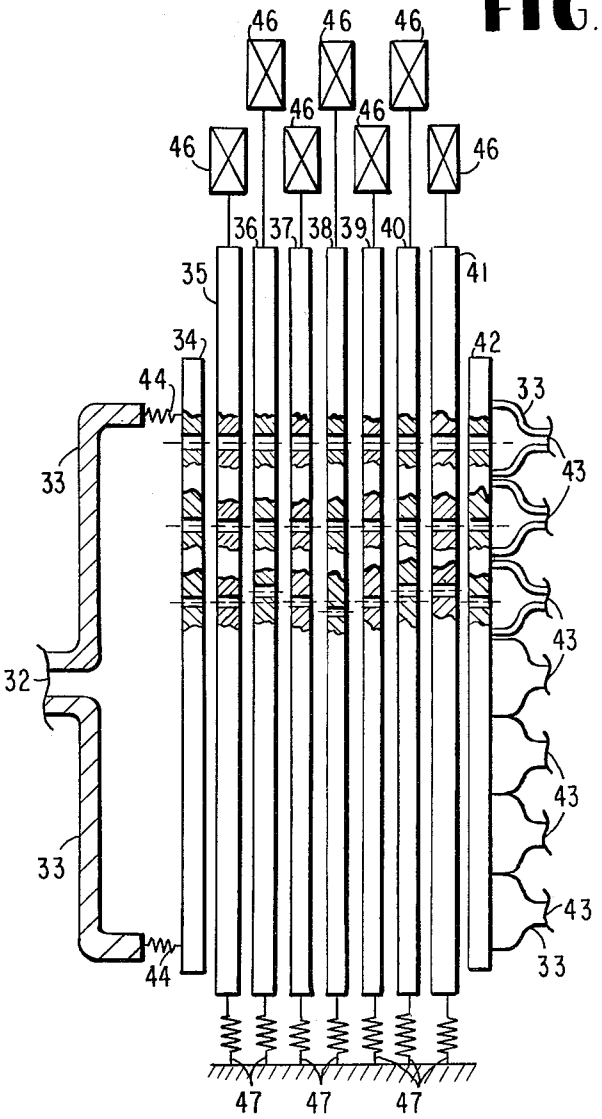
FIG. 12 is a sectional view showing the basic construction of an electrically controlled valve.

FIG. 12 is a sectional view of the basic construction of the overall electrically controlled valve.

In FIG. 12, 46 is electric magnet to operate character code boards 35 to 41, 47 is a spring to convey character code board to a fixed position when the electric magnet is not working. As shown in FIG. 12, air inlet 32 is provided only once in general, but outlets 43 are provided in the same number as pneumatic motors 4 used, in other words, as the number of dots.

The character code boards can be simply and accurately produced using metallic plates made by the photoetching method. and the cost is low.

The gap between two adjoining character code boards is made as small as possible in order to avoid the loss caused by the leakage of air and prevent miprinting caused by leakage of air into the adjoining opening. Also, a fluid or solid lubricant (such as polytetrafluoroethylene) is put into the gap in order to reduce the mechanical friction loss.

Air Passage Board 34 is pushed in the right direction in the drawing when it receives the pressure of the compressed air. However, since connecting means 44 is elastic, the gap between air passage board 34 and character code boards 35 to 41 is compressed by the force of the compressed air and the leakage of air is reduced. If character code boards 35 to 41 and moved when no compressed air is present, they can be moved with only a slight force.

By using electrically controlled valve 31, as shown in FIG. 12, many pneumatic motors can be driven by electric magnet in smaller number, so this dot printer is economical. In the foregoing example, only 7 pcs electric magnets, corresponding to a 7-bit input signal, is needed to control 35 pcs pneumatic motors 4.

Since electrically controlled valve 31 fulfils the function of electrically controlled valve 3, at the same time fulfils the function of a character generator, it is unnecessary to provide a character generator separately. Thus, the dot in this invention is economical also in this respect.

While the invention has been described in detail and with reference to specific embodiments thereof, it will be apparent to one skilled in the art that various changes and modifications can be made therein without departing from the spirit and scope thereof.

What is claimed is:

1. A dot printer comprising:

a pneumatic pressure source containing air compressed to a pressure higher than atmospheric pressure;

a plurality of pneumatic motors adapted to be actuated by the compressed air;

a dot-printing wire associated with each of said motors for imprinting a dot on a printing medium upon the actuation of the associated motor;

first electrically operated valve means for selectively permitting the transmission of the compressed air from said source to selected individual ones of said motors only in response to an electric signal representing a desired character pattern, whereby the selected motors are actuated to imprint the desired character pattern on the printing medium; said valve means comprising a plurality of first valves pneumatically coupled to respective ones of said plurality of motors and operated only in response to the electric signal to permit the transmission of the compressed air; and second electrically operated valve means, coupled between said pneumatic source and said plurality of first valves and normally blocking the transmission of compressed air from said source to said first valves, for transmitting compressed air from said source simultaneously through all of the operated said first valves only after they are operated, and thence to said selected motors.

2. A dot printer as defined in claim 1 in which each of said motors has an inlet coupled to a corresponding one of said first valves and a movable wire-actuator coupled to said inlet, the area of said inlet controlled by said corresponding first valve being smaller than the area of the actuator which is subjected to the force of the compressed air.

3. A dot printer as defined in claim 1 wherein said pneumatic source comprises means for intermittently supplying the compressed air, and wherein said first valves are operated to transmit air only when the air pressure is low.

4. A dot printer as defined in claim 1 wherein said printer is a line printer, the dot-printing wires are arranged in a stationary horizontal array across said printing medium, and said printing medium is movable.

5. A dot printer as defined in claim 1 wherein said printer is a serial printer, the dot-printing wires are arranged in a rectangular matrix movable across said printing medium, and said printing medium is stationary.

6. A dot printer as defined in claim 1 wherein said electrically operated valve means comprises a plurality of air blocking members stacked in the direction of the flow of the compressed air, each member having an opening therein, and means for selectively shifting the position of each member in a direction transverse to the air flow in accordance with a desired character code, whereby an individual motor is actuated only when the openings in all of the members are aligned in the direction of air flow, thereby causing the associated wire to print a dot in a position corresponding to the actuated motor.

7. A dot printer as defined in claim 2 wherein said electrically operated valve means comprises a plurality of air blocking members stacked in the direction of the flow of the compressed air, each member having an opening therein, and means for selectively shifting the position of each member in a direction transverse to the air flow in accordance with a desired character code, whereby an individual motor is actuated only when the openings in all of the members are aligned in the direction of air flow, thereby causing the associated wire to print a dot in a position corresponding to the actuated motor.

8. A dot printer comprising:

a pneumatic pressure source containing air compressed to a pressure higher than atmospheric pressure;

a plurality of pneumatic motors adapted to be actuated by the compressed air;

a dot-printing wire associated with each of said motors for imprinting a dot on a printing medium upon the actuation of the associated motor;

first electrically operated valve means for selectively permitting the transmission of the compressed air from said source to selected individual ones of said motors only in response to an electric signal representing a desired character pattern, whereby the selected motors are actuated to imprint the desired character pattern on the printing medium; said pneumatic source comprising means for intermittently supplying the compressed air, and wherein said valve means is operated to transmit air only when the air pressure is low; and means for converting the potential energy of the compressed air, not consumed by actuation of a motor, into kinetic energy and for utilizing the kinetic energy to aid the compressing action of said pneumatic pressure source.

9. The dot printer as claimed in claim 8 wherein said pneumatic pressure source comprises a rotating shaft driven by a motor, a crank mounted on said rotating shaft, a piston reciprocatingly driven by said crank, a flywheel mounted on said rotating shaft, and a check valve for permitting the suction of air into said source when the air pressure falls below atmospheric pressure.

10. The dot printer as claimed in claim 8 wherein said pneumatic pressure source comprises a moving coil motor whose moving portion moves in a rectilinear path, a piston driven by said moving coil motor, and a spring which holds said piston at a definite position when said piston is not driven.

11. A dot printer comprising:

a pneumatic pressure source containing air compressed to a pressure higher than atmospheric pressure;

a plurality of pneumatic motors adapted to be actuated by the compressed air;

a dot-printing wire associated with each of said motors for imprinting a dot on a printing medium upon the actuation of the associated motor;

first electrically operated valve means for selectively permitting the transmission of the compressed air from said source to selected individual ones of said motors only in response to an electric signal representing a desired character pattern, whereby the selected motors are actuated to imprint the desired character pattern on the printing medium; wherein said pneumatic pressure source comprises a rotating shaft driven by a motor, a crank mounted on said rotating shaft, a piston reciprocatingly driven by said crank, a flywheel mounted on said rotating shaft, and a check valve for permitting the suction of air into said source when the air pressure falls below atmospheric pressure.

12. A dot printer comprising:

a pneumatic pressure source containing air compressed to a pressure higher than atmospheric pressure;

a plurality of pneumatic motors adapted to be actuated by the compressed air;

a dot-printing wire associated with each of said motors for imprinting a dot on a printing medium upon the actuation of the associated motor;

first electrically operated valve means for selectively permitting the transmission of the compressed air from said source to selected individual ones of said motors only in response to an electric signal representing a desired character pattern, whereby the selected motors are actuated to imprint the desired character pattern on the printing medium; wherein said pneumatic pressure source comprises a moving coil motor whose moving portion moves in a rectilinear path, a piston driven by said moving coil motor, and a spring which holds said piston at a definite position when said piston is not driven.

* * * * *